US008628596B2

(12) United States Patent
Gaeta et al.

(10) Patent No.: US 8,628,596 B2
(45) **Date of Patent: *Jan. 14, 2014**

(54) METHOD OF FORMING STRUCTURED ABRASIVE ARTICLE

(75) Inventors: Anthony C. Gaeta, Lockport, NY (US); Xiaorong You, Shrewsbury, MA (US); William C. Rice, Medway, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 196 days.

This patent is subject to a terminal disclaimer.

(21) Appl. No.: 12/563,888

(22) Filed: Sep. 21, 2009

(65) Prior Publication Data

US 2010/0005727 A1 Jan. 14, 2010

Related U.S. Application Data

(63) Continuation of application No. 11/342,329, filed on Jan. 27, 2006, now Pat. No. 7,591,865.

(60) Provisional application No. 60/648,168, filed on Jan. 28, 2005, provisional application No. 60/671,128, filed on Apr. 14, 2005.

(51) Int. Cl.

| | |
|---|---|
| ***B24D 3/00*** | (2006.01) |
| ***B24D 11/00*** | (2006.01) |
| ***B24D 18/00*** | (2006.01) |
| ***C09K 3/14*** | (2006.01) |

(52) U.S. Cl.

USPC ..... 51/293; 51/295; 51/298; 51/307

(58) Field of Classification Search

None

See application file for complete search history.

(56) References Cited

U.S. PATENT DOCUMENTS

| | | | | |
|---|---|---|---|---|
| 2,292,261 | A | 8/1942 | Albertson | |
| 2,976,256 | A * | 3/1961 | Whittier et al. | 51/298 |
| 3,708,296 | A | 1/1973 | Schlesinger | |
| 4,250,053 | A | 2/1981 | Smith | |
| 4,256,828 | A | 3/1981 | Smith | |
| 4,457,766 | A * | 7/1984 | Caul | 51/298 |
| 4,553,982 | A * | 11/1985 | Korbel et al. | 51/298 |

(Continued)

FOREIGN PATENT DOCUMENTS

| | | | |
|---|---|---|---|
| CN | 1348404 | A | 5/2002 |
| EP | 0035969 | A1 | 9/1981 |
| EP | 0044274 | A2 | 1/1982 |
| EP | 0054509 | A2 | 6/1982 |
| EP | 0094914 | A2 | 11/1983 |
| EP | 0094915 | A2 | 11/1983 |
| EP | 0153904 | A2 | 9/1985 |
| EP | 0164314 | A2 | 12/1985 |
| EP | 0223587 | A1 | 5/1987 |
| EP | 0266513 | A2 | 5/1988 |
| EP | 0407834 | A2 | 1/1991 |
| EP | 0546831 | B1 | 6/1993 |

(Continued)

OTHER PUBLICATIONS

Jim Husman; Nanomaterials at 3M, Coupling Nanotechnology to Business Opportunities PennState Materials Day: Commercial Applications of Nanotechnology, Apr. 15, 2004, 30 pages.

"Standard Test Method for Viscosity by Ford Viscosity Cup"; Copyright by ASTM International; United States; pp. 1-4 (2005).

(Continued)

*Primary Examiner* — Kaj K Olsen

*Assistant Examiner* — Ross J Christie

(74) *Attorney, Agent, or Firm* — Joesph P. Sullivan; Abel Law Group, LLP

(57) ABSTRACT

A method of forming a coated abrasive article includes providing a composite binder and abrasive grains on a backing. The composite binder includes at least 5 wt % of a particulate filler having an average particle size of less than 100 nm. The method also includes curing the composite binder.

21 Claims, 1 Drawing Sheet

(56) References Cited

U.S. PATENT DOCUMENTS

| | | | | | |
|---|---|---|---|---|---|
| 4,665,116 | A | * | 5/1987 | Kornhaber et al. | 524/268 |
| 4,751,102 | A | | 6/1988 | Adair et al. | |
| 4,751,138 | A | * | 6/1988 | Tumey et al. | 51/295 |
| 4,772,530 | A | | 9/1988 | Gottschalk et al. | |
| 4,772,541 | A | | 9/1988 | Gottschalk et al. | |
| 4,836,832 | A | * | 6/1989 | Tumey et al. | 51/293 |
| 4,853,434 | A | | 8/1989 | Block | |
| 4,903,440 | A | | 2/1990 | Kirk et al. | |
| 5,002,856 | A | | 3/1991 | Anderson | |
| 5,059,701 | A | | 10/1991 | Keipert | |
| 5,108,463 | A | | 4/1992 | Buchanan | |
| 5,126,394 | A | | 6/1992 | Revis et al. | |
| 5,129,919 | A | | 7/1992 | Kalinowski et al. | |
| 5,137,542 | A | | 8/1992 | Buchanan et al. | |
| 5,191,101 | A | | 3/1993 | Palazzotto et al. | |
| 5,213,589 | A | * | 5/1993 | Ronning et al. | 51/293 |
| 5,252,694 | A | | 10/1993 | Willett et al. | |
| 5,306,319 | A | | 4/1994 | Krishnan et al. | |
| 5,328,716 | A | | 7/1994 | Buchanan | |
| 5,342,419 | A | | 8/1994 | Hibbard | |
| 5,391,210 | A | * | 2/1995 | Bilkadi et al. | 51/298 |
| 5,417,726 | A | | 5/1995 | Stout et al. | |
| 5,451,446 | A | | 9/1995 | Kincaid et al. | |
| 5,492,550 | A | | 2/1996 | Krishnan et al. | |
| 5,505,747 | A | | 4/1996 | Chesley et al. | |
| 5,549,719 | A | | 8/1996 | Lee et al. | |
| 5,556,437 | A | | 9/1996 | Lee et al. | |
| 5,560,753 | A | | 10/1996 | Schnabel et al. | |
| 5,565,011 | A | | 10/1996 | Follett et al. | |
| 5,571,297 | A | * | 11/1996 | Swei et al. | 51/298 |
| 5,573,619 | A | | 11/1996 | Benedict et al. | |
| 5,573,816 | A | | 11/1996 | Gaeta et al. | |
| 5,700,302 | A | | 12/1997 | Stoetzel et al. | |
| 5,702,811 | A | * | 12/1997 | Ho et al. | 51/295 |
| RE35,709 | E | * | 1/1998 | Culler | 51/308 |
| 5,833,724 | A | * | 11/1998 | Wei et al. | 51/307 |
| 5,840,090 | A | * | 11/1998 | Ho et al. | 51/295 |
| 5,863,306 | A | * | 1/1999 | Wei et al. | 51/295 |
| 5,868,806 | A | | 2/1999 | Nishio et al. | |
| 5,958,794 | A | * | 9/1999 | Bruxvoort et al. | 438/692 |
| 6,077,601 | A | * | 6/2000 | DeVoe et al. | 428/323 |
| 6,120,878 | A | | 9/2000 | Follensbee et al. | |
| 6,165,061 | A | * | 12/2000 | Fujii et al. | 51/308 |
| 6,258,138 | B1 | | 7/2001 | DeVoe et al. | |
| 6,293,980 | B2 | | 9/2001 | Wei et al. | |
| 6,398,826 | B1 | * | 6/2002 | Fujii et al. | 51/295 |
| 6,410,127 | B1 | | 6/2002 | Kamae et al. | |
| 6,432,549 | B1 | | 8/2002 | Kronzer | |
| 6,467,897 | B1 | | 10/2002 | Wu et al. | |
| 6,521,004 | B1 | | 2/2003 | Culler et al. | |
| 6,605,128 | B2 | | 8/2003 | Larson et al. | |
| 6,613,113 | B2 | | 9/2003 | Minick et al. | |
| 6,657,001 | B1 | | 12/2003 | Anderson et al. | |
| 6,660,828 | B2 | | 12/2003 | Thomas et al. | |
| 6,669,745 | B2 | | 12/2003 | Prichard et al. | |
| 6,758,734 | B2 | | 7/2004 | Braunschweig et al. | |
| 6,773,474 | B2 | | 8/2004 | Koehnle et al. | |
| 6,797,023 | B2 | | 9/2004 | Knapp et al. | |
| 6,905,772 | B2 | | 6/2005 | Shoup et al. | |
| 6,929,539 | B2 | | 8/2005 | Schutz et al. | |
| 6,949,129 | B2 | | 9/2005 | Simon | |
| 7,022,801 | B2 | | 4/2006 | Medsker | |
| 7,087,710 | B2 | | 8/2006 | Medsker et al. | |
| 7,497,885 | B2 | | 3/2009 | Kollodge | |
| 7,591,865 | B2 | | 9/2009 | Gaeta et al. | |
| 2002/0037683 | A1 | * | 3/2002 | Goers et al. | 451/41 |
| 2002/0066233 | A1 | * | 6/2002 | McArdle et al. | 51/308 |
| 2002/0090891 | A1 | * | 7/2002 | Adefris et al. | 451/28 |
| 2002/0170236 | A1 | * | 11/2002 | Larson et al. | 51/298 |
| 2003/0049995 | A1 | | 3/2003 | Schutz et al. | |
| 2003/0109662 | A1 | | 6/2003 | Medsker et al. | |
| 2003/0131937 | A1 | | 7/2003 | Konarski | |
| 2003/0134577 | A1 | * | 7/2003 | Coad | 451/41 |
| 2003/0143938 | A1 | | 7/2003 | Braunschweig et al. | |
| 2003/0176156 | A1 | | 9/2003 | Braunschweig et al. | |
| 2003/0200701 | A1 | | 10/2003 | Koehnle et al. | |
| 2004/0020133 | A1 | | 2/2004 | Paxton et al. | |
| 2004/0029511 | A1 | | 2/2004 | Kincaid et al. | |
| 2004/0048057 | A1 | * | 3/2004 | Kendall | 428/323 |
| 2004/0048957 | A1 | | 3/2004 | Medsker et al. | |
| 2004/0147029 | A1 | | 7/2004 | Adam | |
| 2004/0152799 | A1 | | 8/2004 | Miller et al. | |
| 2004/0221515 | A1 | * | 11/2004 | McArdle et al. | 51/308 |
| 2004/0242804 | A1 | | 12/2004 | Medsker et al. | |
| 2005/0019574 | A1 | | 1/2005 | McCrary | |
| 2005/0020190 | A1 | | 1/2005 | Schutz et al. | |
| 2005/0025967 | A1 | | 2/2005 | Lawton et al. | |
| 2005/0032469 | A1 | | 2/2005 | Duescher | |
| 2005/0069714 | A1 | | 3/2005 | Hart et al. | |
| 2005/0223649 | A1 | | 10/2005 | O'Gary et al. | |
| 2005/0262773 | A1 | | 12/2005 | Schutz et al. | |
| 2006/0148642 | A1 | | 7/2006 | Ryu et al. | |
| 2006/0154082 | A1 | | 7/2006 | Miller et al. | |
| 2006/0211563 | A1 | | 9/2006 | Arbab et al. | |
| 2006/0234901 | A1 | | 10/2006 | Scheuing et al. | |
| 2008/0306203 | A1 | | 12/2008 | Adam et al. | |

FOREIGN PATENT DOCUMENTS

| | | | |
|---|---|---|---|
| EP | 1236765 | A1 | 9/2002 |
| EP | 1312655 | A2 | 5/2003 |
| EP | 1342742 | A1 | 9/2003 |
| EP | 1366112 | B1 | 7/2004 |
| EP | 1457509 | A1 | 9/2004 |
| EP | 1463775 | | 10/2004 |
| EP | 1487612 | B1 | 4/2006 |
| EP | 1855841 | | 12/2009 |
| JP | 6-206167 | | 7/1994 |
| JP | 9-503811 | | 4/1997 |
| JP | 9-506557 | | 6/1997 |
| JP | 2000-507885 | | 6/2000 |
| JP | 2001-521831 | | 11/2001 |
| NZ | 335614 | | 9/2009 |
| TW | 389717 | | 9/2009 |
| WO | 9426468 | A1 | 11/1994 |
| WO | 95/11111 | | 4/1995 |
| WO | 95/16547 | | 6/1995 |
| WO | 9609141 | | 3/1996 |
| WO | 98/30358 | | 7/1998 |
| WO | 9828663 | | 7/1998 |
| WO | 9851747 | | 11/1998 |
| WO | 99/22912 | | 5/1999 |
| WO | 0037569 | A1 | 6/2000 |
| WO | 0109260 | A1 | 2/2001 |
| WO | 0234848 | A1 | 5/2002 |
| WO | 02083776 | A1 | 10/2002 |
| WO | 02092660 | A2 | 11/2002 |
| WO | 03055948 | A1 | 7/2003 |
| WO | 2004013231 | A2 | 2/2004 |
| WO | 2004067599 | A1 | 8/2004 |
| WO | 2004081076 | A1 | 9/2004 |
| WO | 2005005506 | A1 | 1/2005 |
| WO | 2005026229 | A1 | 3/2005 |
| WO | 2005035200 | A | 4/2005 |
| WO | 2005047358 | A1 | 5/2005 |
| WO | 2006043072 | A1 | 4/2006 |
| WO | 2006065411 | A1 | 6/2006 |
| WO | 2006069179 | A2 | 6/2006 |
| WO | 2006083688 | A1 | 8/2006 |
| WO | 2006091520 | A1 | 8/2006 |

OTHER PUBLICATIONS

"Standard Test Method for Kinematic Viscosity of Transparent and Opaques Liquids (and the Calculation of Dynamic Viscosity)"; Copyright by ASTM International; United States; pp. 1-10 (1997).

Stephan Sprenger, et al; "Nano-modified Ambient Temperature Curing Epoxy Adhesives"; Special Issue of Adhesion Kleben & Dichten; (Mar. 2004); 5 pgs.

"Excellent Impregnation and Reduced Shrinkage"; hanse-chemie.com; (Dec. 2004); pp. 1-3.

"CAB-O-SIL® Untreated Fumed Silica Properties & Functions," Brochure, 10 pages.

* cited by examiner

METHOD OF FORMING STRUCTURED ABRASIVE ARTICLE

CORRESPONDING APPLICATIONS

The present application is a continuation of U.S. patent application Ser. No. 11/342,329, entitled "METHOD OF FORMING STRUCTURED ABRASIVE ARTICLE," naming inventors Anthony C. Gaeta, Xiaorong You, and William C. Rice, which claims priority from U.S. Provisional Patent Application No. 60/648,168, filed Jan. 28, 2005, entitled "ABRASIVE ARTICLES AND METHODS FOR MAKING SAME," naming inventors Xiaorong You, Anthony C. Gaeta, and William C. Rice and claims priority from U.S. Provisional Patent Application No. 60/671,128, filed Apr. 14, 2005, entitled "METHODS OF FORMING STRUCTURED ABRASIVE ARTICLE," naming inventors Anthony C. Gaeta, Xiaorong You, and William C. Rice, which applications are incorporated by reference herein in their entirety.

FIELD OF THE DISCLOSURE

This disclosure, in general, relates to methods and systems for forming structured abrasive articles.

BACKGROUND

Abrasive articles, such as coated abrasives and bonded abrasives, are used in various industries to machine workpieces, such as by lapping, grinding, or polishing. Machining utilizing abrasive articles spans a wide industrial scope from optics industries, automotive paint repair industries, to metal fabrication industries. In each of these examples, manufacturing facilities use abrasives to remove bulk material or affect surface characteristics of products.

Surface characteristics include shine, texture, and uniformity. For example, manufacturers of metal components use abrasive articles to fine and polish surfaces, and oftentimes desire a uniformly smooth surface. Similarly, optics manufacturers desire abrasive articles that produce defect free surfaces to prevent light diffraction and scattering.

Manufactures also desire abrasive articles that have a high stock removal rate for certain applications. However, there is often a trade-off between removal rate and surface quality. Finer grain abrasive articles typically produce smoother surfaces, yet have lower stock removal rates. Lower stock removal rates lead to slower production and increased cost.

Particularly in the context of coated abrasive articles, manufactures of abrasive articles have introduced surface structures to improve stock removal rate, while maintaining surface quality. Coated abrasive articles having surface structures or patterns of raised abrasive layers, often called engineered or structured abrasives, typically exhibit improved useful life.

However, typical techniques for forming structured abrasive articles are unreliable and suffer from performance limitations. A typical process for forming a structured abrasive article includes coating a backing with a viscous binder, coating the viscous binder with a functional powder, and stamping or rolling structure patterns into the viscous binder. The functional powder prevents the binder from sticking to patterning tools. The binder is subsequently cured.

Imperfect coating of the viscous binder with functional powder leads to binder sticking on patterning tools. Binder sticking produces poor structures, leading to poor product performance and wasted product.

Selection of binders appropriate for typical structured abrasive formation techniques is limited by the process. Typical binders include high loading of traditional fillers that increase the viscosity of the binder. Such traditional fillers affect the mechanical characteristics of the binder. For example, high loading of traditional fillers may adversely affect tensile strength, tensile modulus, and elongation at break characteristics of the binder. Poor mechanical characteristics of the binder allows for loss of abrasive grains, leading to scratching and haze on surfaces and reducing abrasive article life.

Loss of grains also degrades the performance of abrasive articles, leading to frequent replacement. Frequent abrasive article replacement is costly to manufacturers. As such, improved abrasive articles and methods for manufacturing abrasive articles would be desirable.

SUMMARY

In a particular embodiment, a method of forming a structured abrasive article includes coating a backing with a binder formulation, partially curing the binder formulation and forming a pattern in the partially cured binder formulation.

In another embodiment, a method of forming a structured abrasive article includes coating a backing with an abrasive slurry comprising binder and abrasive grains, partially curing the abrasive slurry and forming a pattern in the partially cured abrasive slurry.

In a further embodiment, a method of forming a structured abrasive article includes partially curing a binder formulation to a Viscosity Index of at least about 1.1, forming a pattern of structures in the partially cured binder formulation and further curing the partially cured binder formulation.

BRIEF DESCRIPTION OF THE DRAWINGS

The present disclosure may be better understood, and its numerous features and advantages made apparent to those skilled in the art by referencing the accompanying drawings.

DESCRIPTION OF THE DRAWING (S)

In a particular embodiment, a method of forming an abrasive article, such as a structured abrasive article, includes coating a backing with a binder formulation, partially curing the binder formulation and forming a pattern in the partially cured binder formulation. The binder formulation may be incorporated in abrasive slurry that includes the binder formulation and abrasive grains. The slurry may be applied to the coating. In an exemplary embodiment, the binder formulation is partially cured to a Viscosity Index of at least about 1.1. The method may further include fully curing the patterned and partially cured binder formulation. In an exemplary embodiment, the binder formulation is formed of a nanocomposite binder formulation.

Figure 1:
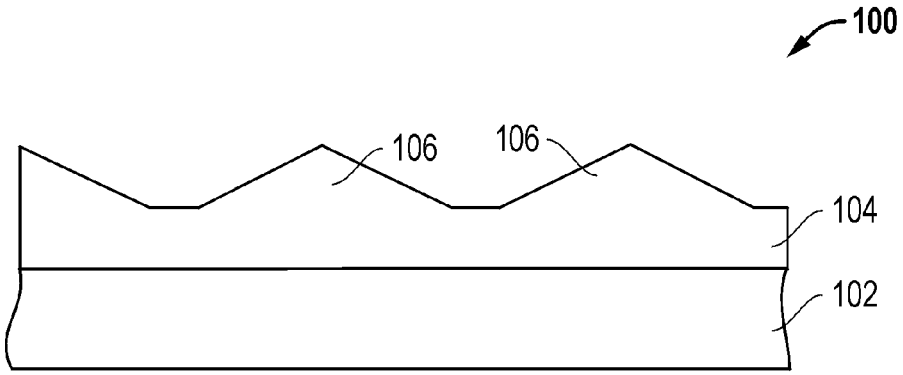
FIG. 1 includes an illustration of an exemplary abrasive article.

Engineered or structured abrasives generally include a pattern of abrasive structures disposed on a backing or support. Exemplary structured abrasives are disclosed in U.S. Pat. No. 6,293,980, which is hereby incorporated by reference in its entirety. An exemplary embodiment of an engineered or structured abrasive is illustrated in FIG. 1. The structured abrasive includes a backing 102 and a layer 104 including abrasive grains. Generally, the layer 104 is patterned to have surface structures 106.

The backing 102 may be flexible or rigid. The backing 102 may be made of any number of various materials including those conventionally used as backings in the manufacture of coated abrasives. An exemplary flexible backing includes a polymeric film (for example, a primed film), such as polyolefin film (e.g., polypropylene including biaxially oriented polypropylene), polyester film (e.g., polyethylene terephthalate), polyamide film, or cellulose ester film; metal foil; mesh; foam (e.g., natural sponge material or polyurethane foam); cloth (e.g., cloth made from fibers or yams comprising polyester, nylon, silk, cotton, poly-cotton or rayon); paper; vulcanized paper; vulcanized rubber; vulcanized fiber; nonwoven materials; a combination thereof, or a treated version thereof. Cloth backings may be woven or stitch bonded. In particular examples, the backing is selected from the group consisting of paper, polymer film, cloth, cotton, poly-cotton, rayon, polyester, poly-nylon, vulcanized rubber, vulcanized fiber, metal foil and a combination thereof. In other examples, the backing includes polypropylene film or polyethylene terephthalate (PET) film.

The backing 102 may optionally have at least one of a saturant, a presize layer or a backsize layer. The purpose of these layers is typically to seal the backing or to protect yarn or fibers in the backing. If the backing 102 is a cloth material, at least one of these layers is typically used. The addition of the presize layer or backsize layer may additionally result in a "smoother" surface on either the front or the back side of the backing 102. Other optional layers known in the art may also be used (for example, a tie layer; see U.S. Pat. No. 5,700,302 (Stoetzel et al.), the disclosure of which is incorporated by reference).

An antistatic material may be included in a cloth treatment material. The addition of an antistatic material can reduce the tendency of the coated abrasive article to accumulate static electricity when sanding wood or wood-like materials. Additional details regarding antistatic backings and backing treatments can be found in, for example, U.S. Pat. Nos. 5,108,463 (Buchanan et al.); 5,137,542 (Buchanan et al.); 5,328,716 (Buchanan); and 5,560,753 (Buchanan et al.), the disclosures of which are incorporated herein by reference.

The backing 102 may be a fibrous reinforced thermoplastic such as described, for example, in U.S. Pat. No. 5,417,726 (Stout et al.), or an endless spliceless belt, as described, for example, in U.S. Pat. No. 5,573,619 (Benedict et al.), the disclosures of which are incorporated herein by reference. Likewise, the backing 102 may be a polymeric substrate having hooking stems projecting therefrom such as that described, for example, in U.S. Pat. No. 5,505,747 (Chesley et al.), the disclosure of which is incorporated herein by reference. Similarly, the backing may be a loop fabric such as that described, for example, in U.S. Pat. No. 5,565,011 (Follett et al.), the disclosure of which is incorporated herein by reference.

In some examples, a pressure-sensitive adhesive is incorporated onto the back side of the coated abrasive article such that the resulting coated abrasive article can be secured to a pad. An exemplary pressure-sensitive adhesive includes latex crepe, rosin, acrylic polymers or copolymers including polyacrylate ester (e.g., poly(butyl acrylate)), vinyl ether (e.g., poly(vinyl n-butyl ether)), alkyd adhesive, rubber adhesive (e.g., natural rubber, synthetic rubber, or chlorinated rubber), or a mixture thereof.

An exemplary rigid backing includes a metal plates, a ceramic plates, or the like. Another example of a suitable rigid backing is described, for example, in U.S. Pat. No. 5,417,726 (Stout et al.), the disclosure of which is incorporated herein by reference.

Layer 104 may be formed as one or more coats. For example, layer 104 may include a make coat and optionally a size coat. Layer 104 generally includes abrasive grains and a binder. In an exemplary embodiment, the abrasive grains are blended with the binder formulation to form abrasive slurry. Alternatively, the abrasive grains are applied over the binder formulation after the binder formulation is coated on backing 102. Optionally, a functional powder may be applied over layer 104 to prevent layer 104 from sticking to the patterning tooling. Alternatively, patterns may be formed in the layer 104 absent the functional powder.

The binder of the make coat or the size coat may be formed of a single polymer or a blend of polymers. For example, the binder may be formed from epoxy, acrylic polymer or a combination thereof. In addition, the binder may include filler, such as nano-sized filler or a combination of nano-sized filler and micron-sized filler. In a particular embodiment, the binder is a colloidal binder, wherein the formulation that is cured to form the binder is a colloidal suspension including particulate filler. Alternatively, or in addition, the binder may be a nanocomposite binder including sub-micron particulate filler.

The structured abrasive article 100 may optionally include compliant and back coats (not shown). These coats may function as described above and may be formed of binder compositions.

The binder generally includes a polymer matrix, which binds abrasive grains to the backing or compliant coat, if present. Typically, the binder is formed of cured binder formulation. In one exemplary embodiment, the binder formulation includes a polymer component and a dispersed phase.

The binder formulation may include one or more reaction constituents or polymer constituents for the preparation of a polymer. A polymer constituent may include a monomeric molecule, a polymeric molecule, or a combination thereof. The binder formulation may further comprise components selected from the group consisting of solvents, plasticizers, chain transfer agents, catalysts, stabilizers, dispersants, curing agents, reaction mediators and agents for influencing the fluidity of the dispersion.

The polymer constituents can form thermoplastics or thermosets. By way of example, the polymer constituents may include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically curable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer;

polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The binder formulation may include a monomer, an oligomer, a polymer, or a combination thereof. In a particular embodiment, the binder formulation includes monomers of at least two types of polymers that when cured may crosslink. For example, the binder formulation may include epoxy constituents and acrylic constituents that when cured form an epoxy/acrylic polymer.

In an exemplary embodiment, the polymer reaction components include anionically and cationically polymerizable precursors. For example, the binder formulation may include at least one cationically curable component, e.g., at least one cyclic ether component, cyclic lactone component, cyclic acetal component, cyclic thioether component, spiro orthoester component, epoxy-functional component, or oxetane-functional component. Typically, the binder formulation includes at least one component selected from the group consisting of an epoxy-functional component and an oxetane-functional component. The binder formulation may include, relative to the total weight of the binder formulation, at least about 10 wt % of a cationically curable component, for example, at least about 20 wt %, typically, at least about 40 wt %, or at least about 50 wt %. Generally, the binder formulation includes, relative to the total weight of the binder formulation, not greater than about 95 wt % of cationically curable components, for example, not greater than about 90 wt %, not greater than about 80 wt %, or not greater than about 70 wt %.

The binder formulation may include at least one epoxy-functional component, e.g. an aromatic epoxy-functional component ("aromatic epoxy") or an aliphatic epoxy-functional component ("aliphatic epoxy"). Epoxy-functional components are components comprising one or more epoxy groups, i.e., one or more three-member ring structures (oxiranes).

Aromatic epoxies components include one or more epoxy groups and one or more aromatic rings. The binder formulation may include one or more aromatic epoxy components. An example of an aromatic epoxy component includes an aromatic epoxy derived from a polyphenol, e.g., from bisphenols, such as bisphenol A (4,4'-isopropylidenediphenol), bisphenol F (bis[4-hydroxyphenyl]methane), bisphenol S (4,4'-sufonyldiphenol), 4,4'-cyclohexylidenebisphenol, 4,4'-biphenol, or 4,4'-(9-fluorenylidene)diphenol. The bisphenol may be alkoxylated (e.g., ethoxylated or propoxylated) or halogenated (e.g., brominated). Examples of bisphenol epoxies include bisphenol diglycidyl ethers, such as diglycidyl ether of Bisphenol A or Bisphenol F.

A further example of an aromatic epoxy includes triphenylolmethane triglycidyl ether, 1,1,1-tris(p-hydroxyphenyl) ethane triglycidyl ether, or an aromatic epoxy derived from a monophenol, e.g., from resorcinol (for example, resorcin diglycidyl ether) or hydroquinone (for example, hydroquinone diglycidyl ether). Another example is nonylphenol glycidyl ether.

In addition, an example of an aromatic epoxy includes epoxy novolac, for example, phenol epoxy novolac and cresol epoxy novolac. A commercial example of a cresol epoxy novolac includes, for example, EPICLON N-660, N-665, N-667, N-670, N-673, N-680, N-690, or N-695, manufactured by Dainippon Ink and Chemicals, Inc. An example of a phenol epoxy novolac includes, for example, EPICLON N-740, N-770, N-775, or N-865, manufactured by Dainippon Ink and Chemicals Inc.

In one embodiment, the binder formulation may contain, relative to the total weight of the binder formulation, at least 10 wt % of one or more aromatic epoxies.

Aliphatic epoxy components have one or more epoxy groups and are free of aromatic rings. The binder formulation may include one or more aliphatic epoxies. An example of an aliphatic epoxy includes glycidyl ether of C2-C30 alkyl; 1,2 epoxy of C3-C30 alkyl; mono or multi glycidyl ether of an aliphatic alcohol or polyol such as 1,4-butanediol, neopentyl glycol, cyclohexane dimethanol, dibromo neopentyl glycol, trimethylol propane, polytetramethylene oxide, polyethylene oxide, polypropylene oxide, glycerol, and alkoxylated aliphatic alcohols; or polyols.

In one embodiment, the aliphatic epoxy includes one or more cycloaliphatic ring structures. For example, the aliphatic epoxy may have one or more cyclohexene oxide structures, for example, two cyclohexene oxide structures. An example of an aliphatic epoxy comprising a ring structure includes hydrogenated bisphenol A diglycidyl ether, hydrogenated bisphenol F diglycidyl ether, hydrogenated bisphenol S diglycidyl ether, bis(4-hydroxycyclohexyl)methane diglycidyl ether, 2,2-bis(4-hydroxycyclohexyl)propane diglycidyl ether, 3,4-epoxycyclohexylmethyl-3,4-epoxycyclohexanecarboxylate, 3,4-epoxy-6-methylcyclohexylmethyl-3,4-epoxy-6-methylcyclohexanecarboxylate, di(3,4-epoxycyclohexylmethyl)hexanedioate, di(3,4-epoxy-6-methylcyclohexylmethyl)hexanedioate, ethylenebis(3,4-epoxycyclohexanecarboxylate), ethanedioldi(3,4-epoxycyclohexylmethyl)ether, or 2-(3,4-epoxycyclohexyl-5,5-spiro-3,4-epoxy)cyclohexane-1,3-dioxane. An example of an aliphatic epoxy is also listed in U.S. Pat. No. 6,410,127, which is hereby incorporated in its entirety by reference.

In an embodiment, the binder formulation includes, relative to the total weight of the binder formulation, at least about 5 wt % of one or more aliphatic epoxies, for example, at least about 10 wt % or at least about 20 wt % of the aliphatic epoxy. Generally, the binder formulation includes, relative to the total weight of the binder formulation, not greater than about 70 wt % of the aliphatic epoxy, for example not greater than about 50 wt %, not greater than about 40 wt %.

Typically, the binder formulation includes one or more mono or poly glycidylethers of aliphatic alcohols, aliphatic polyols, polyesterpolyols or polyetherpolyols. An example of such a component includes 1,4-butanedioldiglycidylether, glycidylether of polyoxyethylene or polyoxypropylene glycol or triol of molecular weight from about 200 to about 10,000; glycidylether of polytetramethylene glycol or poly (oxyethylene-oxybutylene) random or block copolymers. An example of commercially available glycidylether includes a polyfunctional glycidylether, such as Heloxy 48, Heloxy 67, Heloxy 68, Heloxy 107, and Grilonit F713; or monofunctional glycidylethers, such as Heloxy 71, Heloxy 505, Heloxy 7, Heloxy 8, and Heloxy 61 (sold by Resolution Performances, www.resins.com).

The binder formulation may contain about 3 wt % to about 40 wt %, more typically about 5 wt % to about 20 wt % of mono or poly glycidyl ether of an aliphatic alcohol, aliphatic polyols, polyesterpolyol or polyetherpolyol.

The binder formulation may include one or more oxetane-functional components ("oxetanes"). Oxetanes are components having one or more oxetane groups, i.e., one or more four-member ring structures including one oxygen and three carbon members.

Examples of oxetanes include components represented by the following formula:

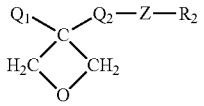

wherein

Q1 represents a hydrogen atom, an alkyl group having 1 to 6 carbon atoms (such as a methyl, ethyl, propyl, or butyl group), a fluoroalkyl group having 1 to 6 carbon atoms, an allyl group, an aryl group, a furyl group, or a thienyl group;

Q2 represents an alkylene group having 1 to 6 carbon atoms (such as a methylene, ethylene, propylene, or butylene group), or an alkylene group containing an ether linkage, for example, an oxyalkylene group, such as an oxyethylene, oxypropylene, or oxybutylene group Z represents an oxygen atom or a sulfur atom; and R2 represents a hydrogen atom, an alkyl group having 1-6 carbon atoms (e.g., a methyl group, ethyl group, propyl group, or butyl group), an alkenyl group having 2-6 carbon atoms (e.g., a 1-propenyl group, 2-propenyl group, 2-methyl-1-propenyl group, 2-methyl-2-propenyl group, 1-butenyl group, 2-butenyl group, or 3-butenyl group), an aryl group having 6-18 carbon atoms (e.g., a phenyl group, naphthyl group, anthranyl group, or phenanthryl group), a substituted or unsubstituted aralkyl group having 7-18 carbon atoms (e.g., a benzyl group, fluorobenzyl group, methoxy benzyl group, phenethyl group, styryl group, cynnamyl group, ethoxybenzyl group), an aryloxyalkyl group (e.g., a phenoxymethyl group or phenoxyethyl group), an alkylcarbonyl group having 2-6 carbon atoms (e.g., an ethylcarbonyl group, propylcarbonyl group, or butylcarbonyl group), an alkoxy carbonyl group having 2-6 carbon atoms (e.g., an ethoxycarbonyl group, propoxycarbonyl group, or butoxycarbonyl group), an N-alkylcarbamoyl group having 2-6 carbon atoms (e.g., an ethylcarbamoyl group, propylcarbamoyl group, butylcarbamoyl group, or pentylcarbamoyl group), or a polyether group having 2-1000 carbon atoms. One particularly useful oxetane includes 3-ethyl-3-(2-ethylhexyloxymethyl) oxetane.

In addition to or instead of one or more cationically curable components, the binder formulation may include one or more free radical curable components, e.g., one or more free radical polymerizable components having one or more ethylenically unsaturated groups, such as (meth)acrylate (i.e., acrylate or methacrylate) functional components.

An example of a monofunctional ethylenically unsaturated component includes acrylamide, N,N-dimethylacrylamide, (meth)acryloylmorpholine, 7-amino-3,7-dimethyloctyl (meth)acrylate, isobutoxymethyl(meth)acrylamide, isobornyloxyethyl (meth)acrylate, isobornyl (meth)acrylate, 2-ethylhexyl (meth)acrylate, ethyldiethylene glycol (meth) acrylate, t-octyl (meth)acrylamide, diacetone (meth)acrylamide, dimethylaminoethyl (meth)acrylate, diethylaminoethyl (meth)acrylate, lauryl (meth)acrylate, dicyclopentadiene (meth)acrylate, dicyclopentenyloxyethyl (meth)acrylate, dicyclopentenyl (meth)acrylate, N,N-dimethyl(meth)acrylamidetetrachlorophenyl (meth)acrylate, 2-tetrachlorophenoxyethyl (meth)acrylate, tetrahydrofurfuryl (meth)acrylate, tetrabromophenyl (meth)acrylate, 2-tetrabromophenoxyethyl (meth)acrylate, 2-trichlorophenoxyethyl (meth)acrylate, tribromophenyl (meth)acrylate, 2-tribromophenoxyethyl (meth)acrylate, 2-hydroxyethyl (meth)acrylate, 2-hydroxypropyl (meth)acrylate, vinylcaprolactam, N-vinylpyrrolidone, phenoxyethyl (meth)acrylate, butoxyethyl (meth)acrylate, pentachlorophenyl (meth)acrylate, pentabromophenyl (meth)acrylate, polyethylene glycol mono(meth) acrylate, polypropylene glycol mono(meth)acrylate, bornyl (meth)acrylate, methyltriethylene diglycol (meth)acrylate, or a combination thereof.

An examples of the polyfunctional ethylenically unsaturated component includes ethylene glycol di(meth)acrylate, dicyclopentenyl di(meth)acrylate, triethylene glycol diacrylate, tertraethylene glycol di(meth)acrylate, tricyclodecanediyldimethylene di(meth)acrylate, trimethylolpropane tri(meth)acrylate, ethoxylated trimethylolpropane tri(meth) acrylate, propoxylated trimethylolpropane tri(meth)acrylate, tripropylene glycol di(meth)acrylate, neopentyl glycol di(meth)acrylate, both-terminal (meth)acrylic acid adduct of bisphenol A diglycidyl ether, 1,4-butanediol di(meth)acrylate, 1,6-hexanediol di(meth)acrylate, polyethylene glycol di(meth)acrylate, (meth)acrylate-functional pentaerythritol derivatives (e.g., pentaerythritol tri(meth)acrylate, pentaerythritol tetra(meth)acrylate, dipentaerythritol hexa(meth) acrylate, dipentaerythritol penta(meth)acrylate, or dipentaerythritol tetra(meth)acrylate), ditrimethylolpropane tetra (meth)acrylate, ethoxylated bisphenol A di(meth)acrylate, propoxylated bisphenol A di(meth)acrylate, ethoxylated hydrogenated bisphenol A di(meth)acrylate, propoxylated-modified hydrogenated bisphenol A di(meth)acrylate, ethoxylated bisphenol F di(meth)acrylate, or a combination thereof.

In one embodiment, the binder formulation comprises one or more components having at least 3 (meth)acrylate groups, for example 3 to 6 (meth)acrylate groups or 5 to 6 (meth) acrylate groups.

In particular embodiments, the binder formulation includes, relative to the total weight of the binder formulation, at least about 3 wt % of one or more free radical polymerizable components, for example, at least about 5 wt % or at least about 9 wt %. Generally, the binder formulation includes not greater than about 50 wt % of free radical polymerizable components, for example, not greater than about 35 wt %, not greater than about 25 wt %, not greater than about 20 wt %, or not greater than about 15 wt %.

Generally, the polymer reaction constituents or precursors have on average at least two functional groups, such as on average at least 2.5 or at least 3.0 functional groups. For example, an epoxy precursor may have 2 or more epoxy-functional groups. In another example, an acrylic precursor may have two or more methacrylate functional groups.

It has surprisingly been found that an binder formulation including a component having a polyether backbone shows excellent mechanical properties after cure of the binder formulation. An example of a compound having a polyether backbone includes polytetramethylenediol, a glycidylether of polytetramethylenediol, an acrylate of polytetramethylenediol, a polytetramethylenediol containing one or more polycarbonate groups, or a combination thereof. In an embodiment, the binder formulation includes between 5 wt % and 20 wt % of a compound having a polyether backbone.

The binder formulation may also include catalysts and initiators. For example, a cationic initiator may catalyze reactions between cationic polymerizable constituents. A radical initiator may activate free-radical polymerization of radically polymerizable constituents. The initiator may be activated by thermal energy or actinic radiation. For example, an initiator may include a cationic photoinitiator that catalyzes cationic polymerization reactions when exposed to actinic radiation. In another example, the initiator may include a radical photoinitiator that initiates free-radical polymerization reactions when exposed to actinic radiation. Actinic radiation includes particulate or non-particulate radiation and is intended to include electron beam radiation and electromagnetic radiation. In a particular embodiment, electromagnetic radiation includes radiation having at least one wavelength in the range of about 100 nm to about 700 nm and, in particular, wavelengths in the ultraviolet range of the electromagnetic spectrum.

Generally, cationic photoinitiators are materials that form active species that, if exposed to actinic radiation, are capable of at least partially polymerizing epoxides or oxetanes. For example, a cationic photoinitiator may, upon exposure to actinic radiation, form cations that can initiate the reactions of cationically polymerizable components, such as epoxies or oxetanes.

An example of a cationic photoinitiator includes, for example, onium salt with anions of weak nucleophilicity. An example includes a halonium salt, an iodosyl salt or a sulfonium salt, such as described in published European patent application EP 153904 and WO 98/28663, a sulfoxonium salt, such as described, for example, in published European patent applications EP 35969, 44274, 54509, and 164314, or a diazonium salt, such as described, for example, in U.S. Pat. Nos. 3,708,296 and 5,002,856. All eight of these disclosures are hereby incorporated in their entirety by reference. Other examples of cationic photoinitiators include metallocene salt, such as described, for example, in published European applications EP 94914 and 94915, which applications are both hereby incorporated in their entirety by reference.

In exemplary embodiments, the binder formulation includes one or more photoinitiators represented by the following formula (1) or (2):

(1)

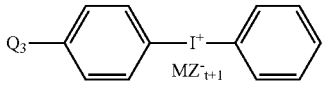

(2)

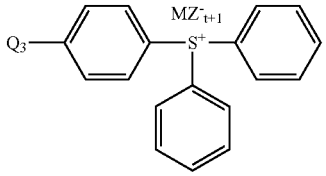

wherein

Q3 represents a hydrogen atom, an alkyl group having 1 to 18 carbon atoms, or an alkoxyl group having 1 to 18 carbon atoms; M represents a metal atom, e.g., antimony; Z represents a halogen atom, e.g., fluorine; and t is the valent number of the metal, e.g., 5 in the case of antimony.

In particular examples, the binder formulation includes, relative to the total weight of the binder formulation, about 0.1 wt % to about 15 wt % of one or more cationic photoinitiators, for example, about 1 wt % to about 10 wt %.

Typically, an onium salt photoinitiator includes an iodonium complex salt or a sulfonium complex salt. Useful aromatic onium complex salts are further described, for example, in U.S. Pat. No. 4,256,828 (Smith), the disclosure of which is incorporated herein by reference. An exemplary aromatic iodonium complex salt includes a diaryliodonium hexafluorophosphate or a diaryliodonium hexafluoroantimonate. An exemplary aromatic sulfonium complex salt includes a triphenylsulfonium hexafluoroantimonate p-phenyl(thiophenyl) diphenylsulfonium hexafluoroantimonate, or a sulfonium (thiodi-4,1-phenylene)bis(diphenyl-bis((OC-6-11)hexafluoroantimonate)).

Aromatic onium salts are typically photosensitive only in the ultraviolet region of the spectrum. However, they can be sensitized to the near ultraviolet and the visible range of the spectrum by sensitizers for known photolyzable organic halogen compounds. An exemplary sensitizer includes an aromatic amine or a colored aromatic polycyclic hydrocarbon, as described, for example, in U.S. Pat. No. 4,250,053 (Smith), the disclosure of which is incorporated herein by reference.

A suitable photoactivatable organometallic complex salt includes those described, for example, in U.S. Pat. Nos. 5,059,701 (Keipert); 5,191,101 (Palazzotto et al.); and 5,252,694 (Willett et al.), the disclosures of which are incorporated herein by reference. An exemplary organometallic complex salt useful as photoactivatable initiators includes: ($\eta^6$-benzene)($\eta^5$-cyclopentadienyl)$Fe^{1+}$ $SbF_6^-$, ($\eta^6$-toluene)($\eta^5$-cyclopentadienyl)$Fe^{+1}$ $AsF_6^-$, ($\eta^6$-xylene)($\eta^5$-cyclopentadienyl)$Fe^{+1}$ $SbF_6^-$, ($\eta^6$-cumene)($\eta^5$-cyclopentadienyl)$Fe^{+1}$ $PF_6^-$, ($\eta^6$-xylenes (mixed isomers))($\eta^5$-cyclopentadienyl)$Fe^{+1}$ $SbF_6^-$, ($\eta^6$-xylenes (mixed isomers))($\eta^5$-cyclopentadienyl)$Fe^{+1}$ $PF_6^-$, ($\eta^6$-o-xylene)($\eta^5$-cyclopentadienyl)$Fe^{+1}$ $CF_3$ $SO_3^-$, ($\eta^6$-xylene) 5-cyclopentadienyl)$Fe^{+1}$ $BF_4^-$, ($\eta^6$-mesitylene)($\eta^5$-cyclopentadienyl)$Fe^{+1}$ $SbF_6^-$, ($\eta^6$-hexamethylbenzene)($\eta^5$-cyclopentadienyl)$Fe^{+1}$ $SbF_5OH^-$, ($\eta^6$-fluorene)($\eta^5$-cyclopentadienyl)$Fe^{+1}$ $SbF_6^-$, or a combination thereof.

Optionally, organometallic salt catalysts can be accompanied by an accelerator, such as an oxalate ester of a tertiary alcohol. If present, the accelerator desirably comprises from about 0.1% to about 4% by weight of the total binder formulation.

A useful commercially available cationic photoinitiator includes an aromatic sulfonium complex salt, available, for example, under the trade designation "FX-512" from Minnesota Mining and Manufacturing Company, St. Paul, Minn., an aromatic sulfonium complex salt having the trade designation "UVI-6974", available from Dow Chemical Co., or Chivacure 1176.

The binder formulation may optionally include photoinitiators useful for photocuring free-radically polyfunctional acrylates. An example of a free radical photoinitiator includes benzophenone (e.g., benzophenone, alkyl-substituted benzophenone, or alkoxy-substituted benzophenone); benzoin (e.g., benzoin, benzoin ethers, such as benzoin methyl ether, benzoin ethyl ether, and benzoin isopropyl ether, benzoin phenyl ether, and benzoin acetate); acetophenone, such as acetophenone, 2,2-dimethoxyacetophenone, 4-(phenylthio) acetophenone, and 1,1-dichloroacetophenone; benzil ketal, such as benzil dimethyl ketal, and benzil diethyl ketal; anthraquinone, such as 2-methylanthraquinone, 2-ethylanthraquinone, 2-tertbutylanthraquinone, 1-chloroanthraquinone, and 2-amylanthraquinone; triphenylphosphine; benzoylphosphine oxides, such as, for example, 2,4,6-trimethylbenzoyldiphenylphosphine oxide; thioxanthone or xanthone; acridine derivative; phenazine derivative; quinoxaline derivative; 1-phenyl-1,2-propanedione-2-O-benzoyloxime; 1-aminophenyl ketone or 1-hydroxyphenyl ketone, such as 1-hydroxycyclohexyl phenyl ketone, phenyl (1-hydroxyisopropyl)ketone and 4-isopropylphenyl(1-hydroxyisopropyl) ketone; or a triazine compound, for example, 4'''-methyl thiophenyl-1-di(trichloromethyl)-3,5-S-triazine, S-triazine-2-(stilbene)-4,6-bistrichloromethyl, or paramethoxy styryl triazine.

An exemplary photoinitiator includes benzoin or its derivative such as α-methylbenzoin; U-phenylbenzoin; α-allylbenzoin; α-benzylbenzoin; benzoin ethers such as benzil dimethyl ketal (available, for example, under the trade designation "IRGACURE 651" from Ciba Specialty Chemicals), benzoin methyl ether, benzoin ethyl ether, benzoin n-butyl ether; acetophenone or its derivative, such as 2-hydroxy-2-methyl-1-phenyl-1-propanone (available, for example, under the trade designation "DAROCUR 1173" from Ciba Specialty Chemicals) and 1-hydroxycyclohexyl phenyl ketone (available, for example, under the trade designation "IRGACURE 184" from Ciba Specialty Chemicals); 2-methyl-1-[4-(methylthio)phenyl]-2-(4-morpholinyl)-1-propanone (available, for example, under the trade designation "IRGACURE 907" from Ciba Specialty Chemicals); 2-benzyl-2-(dimethlamino)-1-[4-(4-morpholinyl)phenyl]-1-butanone (available, for example, under the trade designation "IRGACURE 369" from Ciba Specialty Chemicals); or a blend thereof.

Another useful photoinitiator includes pivaloin ethyl ether, anisoin ethyl ether; anthraquinones, such as anthraquinone, 2-ethylanthraquinone, 1-chloroanthraquinone, 1,4-dimethylanthraquinone, 1-methoxyanthraquinone, benzanthraquinonehalomethyltriazines, and the like; benzophenone or its derivative; iodonium salt or sulfonium salt as described hereinabove; a titanium complex such as bis(η5-2,4-cyclopentadienyl)bis[2,-6-difluoro-3-(1H-pyrrolyl)phenyl)titanium (commercially available under the trade designation "CGI784DC", also from Ciba Specialty Chemicals); a halomethylnitrobenzene such as 4-bromomethylnitrobenzene and the like; or mono- or bis-acylphosphine (available, for example, from Ciba Specialty Chemicals under the trade designations "IRGACURE 1700", "IRGACURE 1800", "IRGACURE 1850", and "DAROCUR 4265"). A suitable photoinitiator may include a blend of the above mentioned species, such as α-hydroxy ketone/acrylphosphin oxide blend (available, for example, under the trade designation IRGACURE 2022 from Ciba Specialty Chemicals.)

A further suitable free radical photoinitiator includes an ionic dye-counter ion compound, which is capable of absorbing actinic rays and producing free radicals, which can initiate the polymerization of the acrylates. See, for example, published European Patent Application 223587, and U.S. Pat. Nos. 4,751,102, 4,772,530 and 4,772,541, all four of which are hereby incorporated in their entirety by reference.

A photoinitiator can be present in an amount not greater than about 20 wt %, for example, not greater than about 10 wt %, and typically not greater than about 5 wt %, based on the total weight of the binder formulation. For example, a photoinitiator may be present in an amount of 0.1 wt % to 20.0 wt %, such as 0.1 wt % to 5.0 wt %, or most typically 0.1 wt % to 2.0 wt %, based on the total weight of the binder formulation, although amounts outside of these ranges may also be useful. In one example, the photoinitiator is present in an amount at least about 0.1 wt %, such as at least about 1.0 wt % or in an amount 1.0 wt % to 10.0 wt %.

Optionally, a thermal curative may be included in the binder formulation. Such a thermal curative is generally thermally stable at temperatures at which mixing of the components takes place. Exemplary thermal curatives for epoxy resins and acrylates are well known in the art, and are described, for example, in U.S. Pat. No. 6,258,138 (DeVoe et al.), the disclosure of which is incorporated herein by reference. A thermal curative may be present in a binder precursor in any effective amount. Such amounts are typically in the range of about 0.01 wt % to about 5.0 wt %, desirably in the range from about 0.025 wt % to about 2.0 wt % by weight, based upon the weight of the binder formulation, although amounts outside of these ranges may also be useful.

The binder formulation may also include other components such as solvents, plasticizers, crosslinkers, chain transfer agents, stabilizers, dispersants, curing agents, reaction mediators and agents for influencing the fluidity of the dispersion. For example, the binder formulation can also include one or more chain transfer agents selected from the group consisting of polyol, polyamine, linear or branched polyglycol ether, polyester and polylactone.

In another example, the binder formulation may include additional components, such as a hydroxy-functional or an amine functional component and additive. Generally, the particular hydroxy-functional component is absent curable groups (such as, for example, acrylate-, epoxy-, or oxetane groups) and are not selected from the group consisting of photoinitiators.

The binder formulation may include one or more hydroxy-functional components. A hydroxy-functional component may be helpful in further tailoring mechanical properties of the binder formulation upon cure. A hydroxy-functional component include a monol (a hydroxy-functional component comprising one hydroxy group) or a polyol (a hydroxy-functional component comprising more than one hydroxy group).

A representative example of a hydroxy-functional component includes an alkanol, a monoalkyl ether of polyoxyalkyleneglycol, a monoalkyl ether of alkyleneglycol, alkylene and arylalkylene glycol, such as 1,2,4-butanetriol, 1,2,6-hexanetriol, 1,2,3-heptanetriol, 2,6-dimethyl-1,2,6-hexanetriol, (2R,3R)-(−)-2-benzyloxy-1,3,4-butanetriol, 1,2,3-hexanetriol, 1,2,3-butanetriol, 3-methyl-1,3,5-pentanetriol, 1,2,3-cyclohexanetriol, 1,3,5-cyclohexanetriol, 3,7,11,15-tetramethyl-1,2,3-hexadecanetriol, 2-hydroxymethyltetrahydropyran-3,4,5-triol, 2,2,4,4-tetramethyl-1,3-cyclobutanediol, 1,3-cyclopentanediol, trans-1,2-cyclooctanediol, 1,16-hexadecanediol, 3,6-dithia-1,8-octanediol, 2-butyne-1,4-diol, 1,2- or 1,3-propanediol, 1,2- or 1,4-butanediol, 1,5-pentanediol, 1,6-hexanediol, 1,7-heptanediol, 1,8-octanediol, 1,9-nonanediol, 1-phenyl-1,2-ethanediol, 1,2-cyclohexanediol, 1,5-decalindiol, 2,5-dimethyl-3-hexyne-2,5-diol, 2,2,4-trimethylpentane-1,3-diol, neopentylglycol, 2-ethyl-1,3-hexanediol, 2,7-dimethyl-3,5-octadiyne-2-7-diol, 2,3-butanediol, 1,4-cyclohexanedimethanol, polyoxyethylene or polyoxypropylene glycols or triols of molecular weights from about 200 to about 10,000, polytetramethylene glycols of varying molecular weight, poly(oxyethylene-oxybutylene) random or block copolymers, copolymers containing pendant hydroxy groups formed by hydrolysis or partial hydrolysis of vinyl acetate copolymers, polyvinylacetal resins containing pendant hydroxyl groups, hydroxy-functional (e.g., hydroxy-terminated) polyesters or hydroxy-functional (e.g., hydroxy-terminated) polylactones, aliphatic polycarbonate polyols (e.g., an aliphatic polycarbonate diol), hydroxy-functional (e.g., hydroxy-terminated) polyethers (e.g., polytetrahydrofuran polyols having a number average molecular weight in the range of 150-4000 g/mol, 150-1500 g/mol, or 150-750 g/mol), or a combination thereof. An exemplary polyol further includes aliphatic polyol, such as glycerol, trimethylolpropane, or also sugar alcohol, such as erythritol, xylitol, mannitol or sorbitol. In particular embodiments, the binder formulation includes one or more alicyclic polyols, such as 1,4-cyclohexane-dimethanol, sucrose, or 4,8-bis(hydroxymethyl) tricyclo(5,2,1,0)decane.

A suitable polyether for the binder formulation includes, in particular, linear or branched polyglycol ether obtainable by ring-opening polymerization of cyclic ether in the presence of polyol, e.g., the aforementioned polyol; polyglycol ether, polyethylene glycol, polypropylene glycol or polytetramethylene glycol or a copolymer thereof.

Another suitable polyester for the binder formulation includes a polyester based on polyols and aliphatic, cycloaliphatic or aromatic polyfunctional carboxylic acids (for example, dicarboxylic acids), or specifically all corresponding saturated polyesters which are liquid at temperatures of 18° C. to 300° C., typically 18° C. to 150° C.: typically succinic ester, glutaric ester, adipic ester, citric ester, phthalic ester, isophthalic ester, terephthalic ester or an ester of corresponding hydrogenation products, with the alcohol component being composed of monomeric or polymeric polyols, for example, of those of the above-mentioned kind.

A further polyester includes aliphatic polylactone, such as ϵ-polycaprolactone, or polycarbonate, which, for example, are obtainable by polycondensation of diol with phosgene. For the binder formulation it is typical to use polycarbonate of bisphenol A having an average molecular weight of from 500 to 100,000.

For the purpose of influencing the viscosity of the binder formulation and, in particular, viscosity reduction or liquefaction, the polyol, polyether or saturated polyester or mixtures thereof may, where appropriate, be admixed with a further suitable auxiliary, particularly a solvent, a plasticizer, a diluent or the like. In an embodiment, the compositions may comprise, relative to the total weight of the binder formulation, not greater than about 15 wt %, such as not greater than about 10 wt %, not greater than about 6 wt %, not greater than about 4 wt %, not greater than about 2 wt %, or about 0 wt % of a hydroxy-functional component. In one example, the binder formulations are free of substantial amounts of a hydroxy-functional component. The absence of substantial amounts of hydroxy-functional components may decrease the hygroscopicity of the binder formulations or articles obtained therewith.

An example of a hydroxy or an amine functional organic compound for making condensation product with an alkylene oxide includes a polyol having 3 to 20 carbon atoms, a (C8-C18) fatty acid (C1-C8) alkanol amides like fatty acid ethanol amides, a fatty alcohol, an alkylphenol or a diamine having 2 to 5 carbon atoms. Such compounds are reacted with alkylene oxide, such as ethylene oxide, propylene oxide or mixtures thereof. The reaction may take place in a molar ratio of hydroxy or amine containing organic compound to alkyleneoxide of, for example, 1:2 to 1:65. The condensation product typically has a weight average molecular weight of about 500 to about 10,000, and may be branched, cyclic, linear, and either a homopolymer, a copolymer or a terpolymer.

The binder formulation may further include a dispersant for interacting with and modifying the surface of the particulate filler. For example, a dispersant may include organosiloxane, functionalized organosiloxane, alkyl-substituted pyrrolidone, polyoxyalkylene ether, ethyleneoxide propyleneoxide copolymer or a combination thereof. For various particulate fillers and, in particular, for silica filler, a suitable surface modifier includes siloxane.

An example of siloxane includes functionalized or non-functionalized siloxane. An example of a siloxane includes a compound represented by the formula,

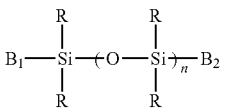

wherein each R is independently a substituted or unsubstituted linear, branched or cyclic C1-10 alkyl, C1-10 alkoxy, substituted or unsubstituted aryl, aryloxy, trihaloalkyl, cyanoalkyl or vinyl group; wherein B1 or B2 is a hydrogen, siloxy group, vinyl, silanol, alkoxy, amine, epoxy, hydroxy, (meth)acrylate, mercapto or solvent phobic groups such as lipophilic or hydrophilic (e.g., anionic, cationic) groups; and wherein n is an integer from about 1 to about 10,000, particularly from about 1 to about 100.

In general, the functionalized siloxane is a compound having a molecular weight ranging from about 300 to about 20,000. Such compounds are commercially available from, for example, the General Electric Company or from Goldschmidt, Inc. A typical functionalized siloxane is an amine functionalized siloxane wherein the functionalization is typically terminal to the siloxane.

Exemplary organosiloxanes are sold under the name Silwet by Witco Corporation. Such organosiloxanes typically have an average weight molecular weight of about 350 to about 15,000, are hydrogen or C1-C4 alkyl capped and may be hydrolyzable or non-hydrolyzable. Typical organosiloxanes include those sold under the name of Silwet L-77, L-7602, L-7604 and L-7605, which are polyalkylene oxide modified dialkyl polysiloxanes.

An example of a suitable anionic dispersant includes (C8-C16) alkylbenzene sulfonate, (C8-C16) alkane sulfonate, (C8-C18) α-olefin sulfonate, α-sulfo (C8-C16) fatty acid methyl ester, (C8-C16) fatty alcohol sulfate, mono- or dialkyl sulfosuccinate with each alkyl independently being a (C8-C16) alkyl group, alkyl ether sulfate, a (C8-C16) salt of carboxylic acid or isethionate having a fatty chain of about 8 to about 18 carbons, for example, sodium diethylhexyl sulfosuccinate, sodium methyl benzene sulfonate, or sodium bis (2-ethylhexyl) sulfosuccinate (for example, Aerosol OT or AOT).

Typical, the dispersant is a compound selected from an organosiloxane, a functionalised organosiloxane, an alkyl-substituted pyrrolidone, a polyoxyalkylene ether, or a ethyleneoxide propylenenoxide block copolymer.

An example of a commercial dispersant includes a cyclic organo-silicone (e.g., SF1204, SF1256, SF1328, SF1202 (decamethyl-cyclopentasiloxane(pentamer)), SF1258, SF1528, Dow Corning 245 fluids, Dow Corning 246 fluids, dodecamethyl-cyclo-hexasiloxane (heximer), and SF1173); a copolymer of a polydimethylsiloxane and a polyoxyalkylene oxide (e.g., SF1488 and SF1288); linear silicon comprising oligomers (e.g., Dow Corning 200 (R) fluids); Silwet L-7200, Silwet L-7600, Silwet L-7602, Silwet L-7605, Silwet L-7608, or Silwet L-7622; a nonionic surfactants (e.g., Triton X-100, Igepal CO-630, PVP series, Airvol 125, Airvol 305, Airvol 502 and Airvol 205); an organic polyether (e.g., Surfynol 420, Surfynol 440 and Surfynol 465); or Solsperse 41000.

Another exemplary commercial dispersant includes SF 1173 (from GE Silicones); an organic polyether like Surfynol 420, Surfynol 440, and Surfynol 465 (from Air Products Inc); Silwet L-7200, Silwet L-7600, Silwet L-7602, Silwet L-7605, Silwet L-7608, or Silwet L-7622 (from Witco) or non-ionic surfactant such as Triton X-100 (from Dow Chemicals), Igepal CO-630 (from Rhodia), PVP series (from ISP Technologies) and Solsperse 41000 (from Avecia).

The amount of dispersant ranges from 0 wt % to 5 wt %. More typically, the amount of dispersant is between 0.1 wt % and 2 wt %. The silanes are typically used in concentrations from 40 mol % to 200 mol % and, particularly, 60 mol % to 150 mol % relative to the molecular quantity surface active sites on the surface of the nano-sized particulate filler. Generally, the binder formulation includes not greater than about 5 wt % dispersant, such as about 0.1 wt % to about 5.0 wt % dispersant, based on the total weight of the binder formulation.

The binder formulation may further include a dispersed phase suspended in an external phase. The external phase typically includes the polymer constituents. The dispersed phase generally includes particulate filler. The particulate filler may be formed of inorganic particles, such as particles of, for example, a metal (such as, for example, steel, silver, or gold) or a metal complex such as, for example, a metal oxide, a metal hydroxide, a metal sulfide, a metal halogen complex, a metal carbide, a metal phosphate, an inorganic salt (like, for example, $CaCO_3$), a ceramic, or a combinations thereof. An example of a metal oxide is ZnO, CdO, $SiO_2$, $TiO_2$, $ZrO_2$, $CeO_2$, $SnO_2$, $MoO_3$, $WO_3$, $Al_2O_3$, $In_2O_3$, $La_2O_3$, $Fe_2O_3$, CuO, $Ta_2O_5$, $Sb_2O_3$, $Sb_2O_5$, or a combination thereof. A mixed oxide containing different metals may also be present. The nanoparticles may include, for example, particles selected from the group consisting of ZnO, $SiO_2$, $TiO_2$, $ZrO_2$, $SnO_2$, $Al_2O_3$, co-formed silica alumina and a mixture thereof. The nanometer sized particles may also have an organic component, such as, for example, carbon black, a highly crosslinked/core shell polymer nanoparticle, an organically modified nanometer-size particle, etc. Such fillers are described in, for example, U.S. Pat. No. 6,467,897 and WO 98/51747, hereby incorporated by reference.

Particulate filler formed via solution-based processes, such as sol-formed and sol-gel formed ceramics, are particularly well suited for use in forming composite binder. Suitable sols are commercially available. For example, colloidal silicas in aqueous solutions are commercially available under such trade designations as "LUDOX" (E.I. DuPont de Nemours and Co., Inc. Wilmington, Del.), "NYACOL" (Nyacol Co., Ashland, Ma.) and "NALCO" (Nalco Chemical Co., Oak Brook, Ill.). Many commercially available sols are basic, being stabilized by alkali, such as sodium hydroxide, potassium hydroxide, or ammonium hydroxide. Additional examples of suitable colloidal silicas are described in U.S. Pat. No. 5,126,394, incorporated herein by reference. Especially well-suited are sol-formed silica and sol-formed alumina. The sols can be functionalized by reacting one or more appropriate surface-treatment agents with the inorganic oxide substrate particles in the sol.

In a particular embodiment, the particulate filler is submicron sized. For example, the particulate filler may be a nano-sized particulate filler, such as a particulate filler having an average particle size of about 3 nm to about 500 nm. In an exemplary embodiment, the particulate filler has an average particle size about 3 nm to about 200 nm, such as about 3 nm to about 100 nm, about 3 nm to about 50 nm, about 8 nm to about 30 nm, or about 10 nm to about 25 nm. In particular embodiments, the average particle size is not greater than about 500 nm, such as not greater than about 200 nm, less than about 100 nm, or not greater than about 50 nm. For the particulate filler, the average particle size may be defined as the particle size corresponding to the peak volume fraction in a small-angle neutron scattering (SANS) distribution curve or the particle size corresponding to 0.5 cumulative volume fraction of the SANS distribution curve.

The particulate filler may also be characterized by a narrow distribution curve having a half-width not greater than about 2.0 times the average particle size. For example, the half-width may be not greater than about 1.5 or not greater than about 1.0. The half-width of the distribution is the width of the distribution curve at half its maximum height, such as half of the particle fraction at the distribution curve peak. In a particular embodiment, the particle size distribution curve is mono-modal. In an alternative embodiment, the particle size distribution is bi-modal or has more than one peak in the particle size distribution.

In a particular embodiment, the binder formulation may include at least two particulate fillers. Each of the particulate fillers may be formed of a material selected from the materials described above in relation to the particulate filler. The particulate fillers may be of the same material or of different materials. For example, each of the particulate fillers may be formed of silica. In an alternative example, one filler may be formed of silica and another filler may be formed of alumina. In an example, each of the particulate fillers has a particle size distribution having an average particle size not greater than about 1000 nm, such as not greater than about 500 nm or less than about 100 nm. In another example, one of the particulate fillers has a particle size distribution having an average particle size not greater than about 1000 nm, such as not greater than about 500 nm or less than about 100 nm, while a second particulate filler has an average particle size greater than about 1 micron, such as about 1 micron to about 10 microns or about 1 micron to about 5 microns. Alternatively, the second particulate filler may have an average particle size as high as 1500 microns. In a particular embodiment, a binder formulation including a first particulate filler having a submicron average particle size and a second particulate filler having an average particle size greater than 1 micron advantageously provides improved mechanical properties when cured to form a binder.

Typically, the second particulate filler has a low aspect ratio. For example, the second particulate filler may have an aspect ratio not greater than about 2, such as about 1 or nearly spherical. Generally, the second particulate filler is untreated and not hardened through treatments. In contrast, abrasive grains typically are hardened particulates with an aspect ratio at least about 2 and sharp edges.

When selecting a second particulate filler, settling speed and viscosity are generally considered. As size increases, particulate fillers having a size greater than 1 micron tend to settle faster, yet exhibit less viscosity at higher loading. In addition, refractive index of the particulate filler may be considered. For example, a particulate filler may be selected with a refractive index at least about 1.35. Further, a particulate filler may be selected that does not include basic residue as basic residue may adversely influence polymerization of cationically polymerizing constituents.

The particulate filler is generally dispersed in a binder formulation. Prior to curing, the particulate filler is colloidally dispersed within the binder suspension and forms a colloidal composite binder once cured. For example, the particulate material may be dispersed such that Brownian motion sustains the particulate filler in suspension. In general, the particulate filler is substantially free of particulate agglomerates. For example, the particulate filler may be substantially mono-disperse such that the particulate filler is dispersed as single particles, and in particular examples, has only insignificant particulate agglomeration, if any.

In a particular embodiment, the particles of the particulate filler are substantially spherical. Alternatively, the particles may have a primary aspect ratio greater than 1, such as at least about 2, at least about 3, or at least about 6, wherein the primary aspect ratio is the ratio of the longest dimension to the smallest dimension orthogonal to the longest dimension. The particles may also be characterized by a secondary aspect ratio defined as the ratio of orthogonal dimensions in a plane generally perpendicular to the longest dimension. The particles may be needle-shaped, such as having a primary aspect ratio at least about 2 and a secondary aspect ratio not greater than about 2, such as about 1. Alternatively, the particles may be platelet-shaped, such as having an aspect ratio at least about 2 and a secondary aspect ratio at least about 2.

In an exemplary embodiment, the particulate filler is prepared in an aqueous solution and mixed with the binder formulation of the suspension. The process for preparing such suspension includes introducing an aqueous solution, such as an aqueous silica solution; polycondensing the silicate, such as to a particle size of 3 nm to 50 nm; adjusting the resulting silica sol to an alkaline pH; optionally concentrating the sol; mixing the sol with constituents of the external fluid phase of the suspension; and optionally removing water or other solvent constituents from the suspension. For example, an aqueous silicate solution is introduced, such as an alkali metal silicate solution (e.g., a sodium silicate or potassium silicate solution) with a concentration in the range between 20% and 50% by weight based on the weight of the solution. The silicate is polycondensed to a particle size of 3 nm to 50 nm, for example, by treating the alkali metal silicate solution with acidic ion exchangers. The resulting silica sol is adjusted to an alkaline pH (e.g., pH>8) to stabilize against further polycondensation or agglomeration of existing particles. Optionally, the sol can be concentrated, for example, by distillation, typically to $SiO_2$ concentration of about 30 to 40% by weight. The sol is mixed with constituents of the external fluid phase. Thereafter, water or other solvent constituents are removed from the suspension. In a particular embodiment, the suspension is substantially water-free.

The fraction of the external phase in the pre-cured binder formulation, generally including the organic polymeric constituents, as a proportion of the binder formulation can be about 20% to about 95% by weight, for example, about 30% to about 95% by weight, and typically from about 50% to about 95% by weight, and even more typically from about 55% to about 80% by weight. The fraction of the dispersed particulate filler phase can be about 5% to about 80% by weight, for example, about 5% to about 70% by weight, typically from about 5% to about 50% by weight, and more typically from about 20% to about 45% by weight. The colloidally dispersed and submicron particulate fillers described above are particularly useful in concentrations at least about 5 wt %, such as at least about 10 wt %, at least about 15 wt %, at least about 20 wt %, or as great as 40 wt % or higher. In contrast with traditional fillers, the solution formed nanocomposites exhibit low viscosity and improved processing characteristics at higher loading. The amounts of components are expressed as weight % of the component relative to the total weight of the binder formulation, unless explicitly stated otherwise.

In a particular embodiment, the binder formulation includes about 10 wt % to about 90 wt % cationically polymerizable compound, not greater than about 40 wt % radically polymerizable compound, and about 5 wt % to about 80 wt % particulate filler, based on the total weight of the binder formulation. It is understood that the sum of the amounts of the binder formulation components adds to 100 wt % and, as such, when amounts of one or more components are specified, the amounts of other components correspond so that the sum of the amounts is not greater than 100 wt %.

The cationically polymerizable compound, for example, includes an epoxy-functional component or a oxetane-functional component. For example, the binder formulation may include about 10 wt % to about 60 wt % cationically polymerizable compound, such as about 20 wt % to about 50 wt % cationically polymerizable compound based on the weight of the binder formulation. The exemplary binder formulation may include not greater than about 20 wt %, such as about 5 wt % to about 20 wt % mono or poly glycidyl ethers of an aliphatic alcohol, aliphatic polyols, polyesterpolyol or polyetherpolyol. The exemplary binder formulation may include not greater than about 50 wt %, such as about 5 wt % to about 50 wt % of a component having a polyether backbone, such as polytetramethylenediol, glycidylethers of polytetramethylenediol, acrylates of polytetramethylenediol or polytetramethylenediol containing one or more polycarbonate groups.

The radically polymerizable compound of the above example, for example, includes components having one or more methacylate groups, such as components having at least 3 methacrylate groups. In another example, the binder formulation includes not greater than about 30 wt %, such as not greater than about 20 wt %, not greater than about 10 wt % or not greater than about 5 wt % radically polymerizable compound.

The formulation may further include not greater than about 20 wt % cationic photoinitiator, such as about 0.1 wt % to about 20 wt %, or not greater than about 20 wt % radical photoinitiator, such as about 0.1 wt % to about 20 wt %. For example, the binder formulation may include not greater than about 10 wt %, such as not greater than about 5 wt % cationic photoinitiator. In another example, the binder formulation may include not greater than about 10 wt %, such as not greater than about 5 wt % free radical photoinitiator.

The particular filler includes dispersed submicron particulates. Generally, the binder formulation includes 5 wt % to 80 wt %, such as 5 wt % to 60 wt %, such as 5 wt % to 50 wt % or 20 wt % to 45 wt % submicron particulate filler. Particular embodiments include at least about 5 wt % particulate filler, such as at least about 10 wt % or at least about 20 wt %. In one particular embodiment, the particulate filler is solution formed silica particulate and may be colloidally dispersed in a polymer component. The exemplary binder formulation may further include not greater than about 5 wt % dispersant, such as 0.1 wt % to 5 wt % dispersant, selected from organosiloxanes, functionalised organosiloxanes, alkyl-substituted pyrrolidines, polyoxyalkylene ethers, and ethyleneoxide propylenenoxide block copolymer.

In a particular embodiment, the binder formulation is formed by mixing a nanocomposite epoxy or acrylate precursor, i.e., a precursor including submicron particulate filler. For example, the binder formulation may include not greater than about 90 wt % nanocomposite epoxy and may include acrylic precursor, such as not greater than 50 wt % acrylic precursor. In another example, a nanocomposite acrylic precursor may be mixed with epoxy.

The binder formulation including polymeric or monomeric constituents and including dispersed particulate filler may be used to form a make coat, a size coat, a compliant coat, or a back coat of a coated abrasive article. In an exemplary process for forming a make coat, the binder formulation is coated on a backing, abrasive grains are applied over the make coat, and the make coat is partially cured before patterning. A size coat may be applied over the make coat and abrasive grains. In another exemplary embodiment, the binder formulation is blended with the abrasive grains to form abrasive slurry that is coated on a backing, partially cured and patterned.

The abrasive grains may be formed of any one of or a combination of abrasive grains, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive grains may be selected from a group consisting of silica, alumina, zirconia, silicon carbide, silicon nitride, boron nitride, garnet, diamond, cofused alumina zirconia, ceria, titanium diboride, boron carbide, flint, emery, alumina nitride, and a blend thereof. Particular embodiments have been created by use of dense abrasive grains comprised principally of alpha-alumina.

The abrasive grain may also have a particular shape. An example of such a shape includes a rod, a triangle, a pyramid, a cone, a solid sphere, a hollow sphere or the like. Alternatively, the abrasive grain may be randomly shaped.

The abrasive grains generally have an average grain size not greater than 2000 microns, such as not greater than about 1500 microns. In another example, the abrasive grain size is not greater than about 750 microns, such as not greater than about 350 microns. For example, the abrasive grain size may be at least 0.1 microns, such as from about 0.1 microns to about 1500 microns, and more typically from about 0.1 microns to about 200 microns or from about 1 micron to about 100 microns. The grain size of the abrasive grains is typically specified to be the longest dimension of the abrasive grain. Generally, there is a range distribution of grain sizes. In some instances, the grain size distribution is tightly controlled.

In a blended abrasive slurry including the abrasive grains and the binder formulation, the abrasive grains provide from about 10% to about 90%, such as from about 30% to about 80%, of the weight of the abrasive slurry.

The abrasive slurry may further include a grinding aid to increase the grinding efficiency and cut rate. A useful grinding aid can be inorganic based, such as a halide salt, for example, sodium cryolite, and potassium tetrafluoroborate; or organic based, such as a chlorinated wax, for example, polyvinyl chloride. A particular embodiment includes cryolite and potassium tetrafluoroborate with particle size ranging from 1 micron to 80 microns, and most typically from 5 microns to 30 microns. The weight percent of grinding aid is generally not greater than about 50 wt %, such as from about 0 wt % to 50 wt %, and most typically from about 10 wt % to 30 wt % of the entire slurry (including the abrasive grains).

The binder formulation may be useful in forming a structured abrasive article. For example, the binder formulation may be coated on a backing, partially cured and patterned to form abrasive structures. In a particular embodiment, the structured abrasive article may be formed without the use of functional powder.

Figure 2:
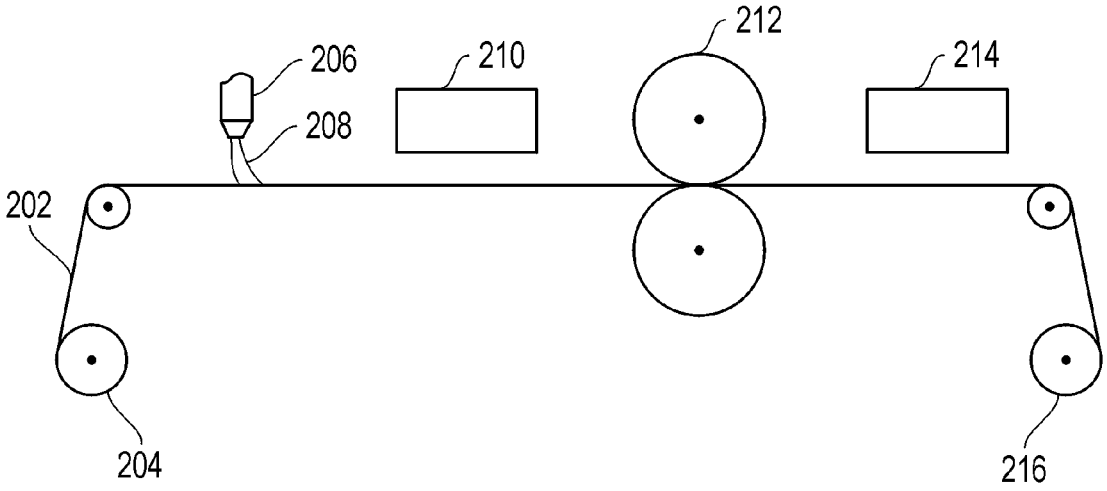
FIG. 2 includes an illustration of an exemplary apparatus for manufacturing structured abrasive articles.

FIG. 2 includes an illustration of an exemplary process. A backing 202 is paid from roll 204. The backing 202 is coated with a binder formulation 208 dispensed from a coating apparatus 206. An exemplary coating apparatus includes a drop die coater, a knife coater, a curtain coater, a vacuum die coater or a die coater. Coating methodologies can include either contact or non contact methods. Such methods include 2 roll, 3 roll reverse, knife over roll, slot die, gravure, extrusion or spray coating applications.

In a particular embodiment, the binder formulation 208 is provided in a slurry including the formulation and abrasive grains. In an alternative embodiment, the binder formulation 208 is dispensed separate from the abrasive grains. The abrasive grains may be provided following coating of the backing 202 with the binder formulation 208, after partial curing of the binder formulation 208, after patterning of the binder formulation 208, or after fully curing the binder formulation 208. The abrasive grains may, for example, be applied by a technique, such as electrostatic coating, drop coating or mechanical projection.

The binder formulation is partially cured through an energy source 210. The selection of the energy source 210 depends in part upon the chemistry of the binder formulation. The energy source 210 may be a source of thermal energy or actinic radiation energy, such as electron beam, ultraviolet light, or visible light. The amount of energy used depends on the chemical nature of the reactive groups in the precursor polymer constituents, as well as upon the thickness and density of the binder formulation 208. For thermal energy, an oven temperature of about 75° C. to about 150° C. and duration of about 5 minutes to about 60 minutes are generally sufficient. Electron beam radiation or ionizing radiation may be used at an energy level of about 0.1 MRad to about 100 MRad, particularly at an energy level of about 1 MRad to about 10 MRad. Ultraviolet radiation includes radiation having a wavelength within a range of about 200 nanometers to about 400 nanometers, particularly within a range of about 250 nanometers to 400 nanometers. Visible radiation includes radiation having a wavelength within a range of about 400 nanometers to about 800 nanometers, particularly in a range of about 400 nanometers to about 550 nanometers. Curing parameters, such as exposure, are generally formulation dependent and can be adjusted via lamp power and belt speed.

In an exemplary embodiment, the energy source 210 provides actinic radiation to the coated backing, partially curing the binder formulation 208. In another embodiment, the binder formulation 208 is thermally curable and the energy source 210 provides heat for thermal treatment. In a further embodiment, the binder formulation 208 may include actinic radiation curable and thermally curable components. As such, the binder formulation may be partially cured through one of thermal and actinic radiation curing and cured to complete curing through a second of thermal and actinic radiation curing. For example, an epoxy constituent of the binder formulation may be partially cured using ultraviolet electromagnetic radiation and an acrylic constituent of the binder formulation may be further cured through thermal curing.

In a particular embodiment, the binder formulation 208 has a viscosity not greater than 3000 cps when measured at room temperature (21° C. or 70° F.). For example, the binder formulation 208 prior to curing may have a viscosity not greater than about 2000 cps, such as not greater than about 1500 cps, not greater than about 1000 cps, or not greater than about 500 cps at room temperature. Alternatively, the binder formulation 208 may have a viscosity greater than 3000 cps. The uncured binder formulation, by itself or in an abrasive slurry, generally flows at the temperature and pressure at which the coating process is performed. For example, the uncured binder formulation may flow at temperatures not greater than about 60° C. (140° F.). The binder formulation 208 may be partially cured prior to patterning to a viscosity, for example, at least about 10,000 cps, such as at least about 20,000 cps or at least about 50,000 cps when measured at room temperature. For example, the partially cured binder formulation may have viscosity at least about 100,000 cps, such as about 500,000 cps or higher when measured at room temperature. In an alternative embodiment, the partially cured binder formulation may have a viscosity less than 10,000 cps. The partially cured binder formulation is typically a viscous liquid that can flow under temperature and pressure. For example, the partially cured binder formulation may be imprinted with a pattern under pressure. In general, the partially cured binder formulation has a higher viscosity than the binder formulation. In particular, the partially cured binder formulation has a Viscosity Index, herein defined as the ratio of the viscosity of the partially cured binder formulation at room temperature to the viscosity of the uncured binder formulation at room temperature, of at least about 1.1. For example, the partially cured binder formulation may have a Viscosity Index of at least about 2.0, such as at least about 5.0 or at least about 10.0.

In a particular embodiment, nanocomposite binders and particularly sol-formed nanocomposite binders are well suited for such applications.

Returning to FIG. 2, once the binder formulation 208 is partially cured, a pattern is imparted to the partially cured binder, such as through a rotogravure 212. Alternately, patterns may be formed in the partially cured binder through stamping or pressing. Typically, an embossing roll produces a desired surface structure with continuous web processes. An embossing roll is used in rotary coating lines and can be described as a nip roll arrangement wherein one roll is a backing roll and another is an "etched" or embossed roll. Compression of the coated web in this nip imparts the "positive" image of the embossed roll onto the web. Such embossing rolls often have recesses that distinguish them from standard gravure or anilox rolls used in the printing industry.

Exemplary patterning tools may be heated. Typically, patterning forms a repeating pattern of abrasive structures. In a particular embodiment, the patterning is performed without functional powder. Alternatively, functional powder may be applied over the binder formulation 208 prior to or after partial curing of the binder formulation 208.

The patterned binder formulation is subsequently fully cured or cured to achieve desirable mechanical properties. The curing may be facilitated through an energy source or the binder formulation may be configured to cure over time. For example, the patterned binder formulation may be further cured by an energy source 214. The energy source 214 may supply actinic radiation or thermal energy to the binder formulation depending on the curing mechanism of the binder formulation.

Once the binder formulation is cured a structured abrasive article is formed. Alternatively, a size coat may be applied over the patterned abrasive structures. In a particular embodiment, the structured abrasive article is rolled into roll 216. In other embodiments, fully curing may be performed after rolling the partially cured abrasive article.

In alternative embodiments, a size coat may be applied over the binder formulation and abrasive grains. For example, the size coat may be applied before partially curing the binder formulation, after partially curing the binder formulation, after patterning the binder formulation, or after further curing the binder formulation. The size coat may be applied by, for example, roll coating or spray coating. Depending on the composition of the size coat and when it is applied, the size coat may be cured in conjunction with the binder formulation or cured separately. A supersize coat including grinding aids may be applied over the size coat and cured with the binder formulation, cured with the size coat or cured separately.

Particular embodiments of the above method are advantageous for manufacturing structured abrasive articles. Such embodiments result in abrasive articles having binders having improved mechanical properties. In particular, some embodiments lead to reduced stress within the abrasive article, improving performance characteristics of the abrasive article, such as haze and surface quality. Embodiments of the above method may also permit increased loading of abrasive grains, leading to improved abrasive article life and stock removal rates.

EXAMPLES

Example Binder Formulations

Examples 1-5 illustrate exemplary binder formulations including polymer constituents and nano-sized particulate filler.

Example 1

The exemplary binder formulations include Nanopox XP 22/0314 available from Hanse Chemie, an epoxy resin including 3,4-epoxy cyclohexyl methyl-3,4-epoxy cyclohexyl carboxylate and 40 wt % colloidal silica particulate filler. The binder formulations also include UVR 6105, which includes 3,4-epoxy cyclohexyl methyl-3,4-epoxy cyclohexyl carboxylate and no particulate filler. The binder formulations further include a polyol (4,8-bis(hydroxymethyl) tricyclo (5.2.1.0)decane), a cationic photoinitiator (Chivacure 1176), a radical photoinitiator (Irgacure 2022, available from Ciba®), and acrylate precursor (SR 399, a dipentaerythritol pentaacrylate available from Atofina-Sartomer, Exton, Pa.). Table 1 illustrates the concentration of components in the binder formulations.

TABLE 1

| | 1.1 Wt % | 1.2 Wt % | 1.3 Wt % | 1.4 Wt % | 1.5 Wt % |
|---|---|---|---|---|---|
| INGREDIENT | | | | | |
| Nanopox XP 22/0314 | 0.00 | 20.00 | 40.00 | 60.00 | 79.92 |
| UVR 6105 | 79.92 | 59.92 | 39.92 | 19.92 | 0.00 |
| 4,8-bis(hydroxymethyl)-tricyclo(5.2.1.0)decane | 13.50 | 13.50 | 13.50 | 13.50 | 13.50 |
| Irgacure 2022 | 0.48 | 0.48 | 0.48 | 0.48 | 0.48 |
| Chivacure 1176 | 1.50 | 1.50 | 1.50 | 1.50 | 1.50 |
| SR 399 | 4.60 | 4.60 | 4.60 | 4.60 | 4.60 |
| RESULTS | | | | | |
| Filler % | 0.00 | 8.00 | 16.00 | 24.00 | 31.97 |

Example 2

In another example, the binder formulations include one polyol selected from the group consisting of Terathane 250, Terathane 1000, 4,8-bis(hydroxymethyl) tricyclo(5.2.1.0)decane, 2-ethyl-1,3-hexanediol, and 1,5-pentanediol. The selected polyol is mixed with Nanopox XP 22/0314, Irgacure 2022, Chivacure 1176, and Nanocryl XP 21/0940. Nanocryl XP 21/0940 is an acrylate precursor (tetraacrylate) including 50 wt % colloidal silica particulate filler, available from Hanse Chemie, Berlin. The concentrations are illustrated in TABLE 2.

TABLE 2

| | 2.1 Wt % | 2.2 Wt % | 2.3 Wt % | 2.4 Wt % | 2.5 Wt % |
|---|---|---|---|---|---|
| INGREDIENT | | | | | |
| Nanopox XP 22/0314 | 74.46 | 74.46 | 74.46 | 74.46 | 74.46 |
| Irgacure 2022 | 0.48 | 0.48 | 0.48 | 0.48 | 0.48 |
| Chivacure 1176 | 1.50 | 1.50 | 1.50 | 1.50 | 1.50 |
| Nanocryl XP 21/0940 | 11.06 | 11.06 | 11.06 | 11.06 | 11.06 |
| Terathane 250 | 12.49 | | | | |
| Terathane 1000 | | 12.49 | | | |
| 4,8-bis(hydroxymethyl)-tricyclo(5.2.1.0)decane | | | 12.49 | | |
| 2-ethyl-1,3-hexanediol | | | | 12.49 | |
| 1,5-pentanediol | | | | | 12.49 |
| RESULTS | | | | | |
| Filler % | 35.32 | 35.32 | 35.32 | 35.32 | 35.32 |
| Tg (tan delta) | 84.25 | 116.55 | 139.8 | 93.6 | 53.85 |
| E' at 23 C. (MPa) | 2374.5 | 2591.5 | 3258 | 2819.5 | 1992 |

Example 3

In this example, three acrylate resins (Nanocryl XP 21/0940 (tetraacrylate), Nanocryl XP 21/0930 (diacrylate), and Nanocryl 21/0954 (trimethylolpropan ethox triacrylate), each including 50 wt % colloidal silica particulate filler and each available from Hanse Chemie) are tested. The binder formulations further include Nanopox XP 22/0314, 1,5-pentanediol, Irgacure 2022, and Chivacure 1176. The compositions are illustrated in Table 3.

TABLE 3

| | 3.4 Wt % | 3.5 Wt % | 3.6 Wt % |
|---|---|---|---|
| INGREDIENT | | | |
| Nanopox XP 22/0314 | 77.28 | 77.28 | 77.28 |
| 1,5-pentanediol | 15.46 | 15.46 | 15.46 |
| Irgacure 2022 | 0.52 | 0.52 | 0.52 |
| Chivacure 1176 | 1.50 | 1.50 | 1.50 |
| Nanocryl XP 21/0940 | 5.15 | | |
| Nanocryl XP 21/0930 | | 5.15 | |
| Nanocryl XP 21/0954 | | | 5.15 |
| RESULTS | | | |
| Filler % | 33.49 | 33.49 | 33.49 |

Example 4

In a further example, the concentrations of two epoxy components (Nanopox XP 22/0314 and Nanopox 22/0516 (bisphenol A diglycidyl ether), each available from Hanse Chemie) having nano-sized silica particulate filler are varied. In addition, an oxetane component, OXT-212 (3-ethyl-3-(2-ethylhexyloxymethyl)oxetane), is included. A polyol (Terathane 250) and a photocatalyst (Chivacure 1176) are included. The compositions are illustrated in Table 4.

TABLE 4

| | 4.1 Wt % | 4.2 Wt % | 4.3 Wt % | 4.4 Wt % |
|---|---|---|---|---|
| INGREDIENT | | | | |
| Nanopox XP 22/0314 | 67.89 | 58.19 | 48.50 | 38.80 |
| Nanopox XP 22/0516 | 9.70 | 19.40 | 29.10 | 38.80 |
| Terathane 250 | 9.70 | 9.70 | 9.70 | 9.70 |
| OXT-212 | 9.70 | 9.70 | 9.70 | 9.70 |
| Chivacure 1176 | 2.91 | 2.91 | 2.91 | 2.91 |
| RESULTS | | | | |
| Filler % | 31.04 | 31.04 | 31.04 | 31.04 |

Example 5

In another example, a sample is prepared using a size coat having the binder formulation illustrated in Table 5. The binder formulation includes both nano-sized filler particles supplied through the addition of Nanopox A 610 and micron-sized fillers (NP-30 and ATH S-3) having an approximate average particle size of 3 microns. NP-30 includes spherical silica particles having an average particle size of about 3 micron. ATH S-3 includes non-spherical alumina anhydride particles having an average particle size of about 3 microns. The sample has a Young's modulus of 8.9 GPa (1300 ksi), a tensile strength of 77.2 MPa (11.2 ksi), and an elongation at break of 1%.

TABLE 5

| INGREDIENT | Wt. % |
|---|---|
| UVR-6105 | 0.71 |
| Heloxy 67 | 6.50 |
| SR-351 | 2.91 |
| DPHA | 1.80 |
| (3-glycidoxypropyl) trimethoxysilane | 1.17 |
| Chivacure 184 | 0.78 |
| NP-30 | 46.71 |
| ATH S-3 | 7.78 |
| Nanopox A 610 | 27.75 |
| Chivacure 1176 | 3.89 |
| SDA 5688 | 0.00072 |

The above-disclosed subject matter is to be considered illustrative, and not restrictive, and the appended claims are intended to cover all such modifications, enhancements, and other embodiments, which fall within the true scope of the present invention.

The invention claimed is:

1. A method of forming a coated abrasive article, the method comprising:

providing a colloidal composite binder composition and abrasive grains on a backing, the colloidal composite binder composition comprising based on the weight of the colloidal composite binder composition, about 5 wt % to about 80 wt % of a dispersion of colloidal silica suspended in an external phase of a cationically curable polymer resin, wherein the colloidal silica has an average particle size of 3 nm to 100 nm;

about 10 wt % to about 60 wt % of cationically polymerizable compound, wherein the cationically polymerizable compound is the same or different than the cationically curable polymer resin in which the colloidal silica is suspended; and about 5 wt % to about 20 wt % of an aliphatic polyol, a polyesterpolyol, or a polyetherpolyol; and curing the composite binder.

2. The method of claim 1, wherein the colloidal composite binder composition is provided as a size coat disposed over the abrasive grains.

3. The method of claim 1, wherein the colloidal composite binder composition is provided as a make coat in which or on which the abrasive grains are disposed.

4. The method of claim 1, wherein the colloidal composite binder composition is provided as a compliant coat over which layers comprising the abrasive grains are disposed.

5. The method of claim 1, wherein providing includes mixing abrasive grains with the colloidal composite binder composition and coating the backing with the colloidal composite binder and the abrasive grains.

6. The method of claim 1, wherein providing includes first coating the colloidal composite binder composition on the backing, followed by coating the abrasive grains thereon.

7. The method of claim 1, wherein providing the colloidal composite binder composition and the abrasive grains on the backing is performed before curing.

8. The method of claim 1, wherein, the free radical polymerizable components are present in an amount of about 3 wt % to not greater than about 50 wt %.

9. The method of claim 1, wherein curing the colloidal composite binder composition comprises thermally curing the colloidal composite binder composition.

10. A method of forming an abrasive article, the method comprising:

coating a backing with abrasive grains and a make coat comprising a first binder;

applying a size coat over the make coat, the size coat comprising a second binder comprising colloidal composite binder composition comprising about 5 wt % to about 80 wt % of a dispersion of colloidal silica suspended in an external phase of a cationically curable polymer resin, wherein the colloidal silica has an average particle size of 3 nm to 100 nm;

about 10 wt % to about 60 wt % of cationically polymerizable compound, wherein the cationically polymerizable compound is the same or different than the cationically curable polymer resin in which the colloidal silica is suspended; and not greater than about 40 wt % of radically polymerizable compound; and about 5 wt % to about 20 wt % of an aliphatic polyol, a polyesterpolyol, or a polyetherpolyol; and curing the make coat and the size coat.

11. The method of claim 10, wherein curing the make coat and the size coat comprises exposing at least one of the make coat and the size coat to actinic radiation.

12. The method of claim 10, wherein curing the make coat and the size coat comprises thermally curing at least one of the make coat and the size coat.

13. The method of claim 10, wherein the first binder includes a second colloidal composite polymer.

14. The method of claim 13, wherein the second colloidal composite polymer is formed from a second solution-formed binder solution including a second particulate filler having an average particle size of less than 100 nm, the first binder comprising at least 5 wt % of the second particulate filler.

15. The method of claim 13, wherein the colloidal composite polymer and the second colloidal composite polymer comprise a common monomer.

16. The method of claim 10, further comprising forming a compliant coat on the backing under the make coat prior to coating the backing with the make coat.

17. A method of forming an abrasive article, the method comprising:

blending a colloidal composite binder composition, the colloidal composite binder composition comprising based on the weight of the colloidal composite binder composition, about 5 wt % to about 80 wt % of a dispersion of colloidal silica suspended in an external phase of a cationically curable polymer resin, wherein the colloidal silica has an average particle size of 3 nm to 100 nm;

about 10 wt % to about 60 wt % of cationically polymerizable compound, wherein the cationically polymerizable compound is the same or different than the cationically curable polymer resin in which the colloidal silica is suspended; and about 5 wt % to about 20 wt % of an aliphatic polyol, a polyesterpolyol, or a polyetherpolyol;

applying the colloidal composite binder composition to a substrate;

applying abrasive grains to the colloidal composite binder composition; and curing the colloidal composite binder composition.

18. The method of claim 17, wherein the substrate comprises backing.

19. The method of claim 1, wherein the polyol is selected from the group consisting of a polytetramethylene glycol, an alicyclic polyol, and combinations thereof.

20. The method of claim 1, wherein the polyol is selected from the group consisting of 2-ethyl-1,3-hexanediol; 1,5-pentanediol; a polytetramethylene ether glycol having a molecular weight from 200 to 1100; and 4,8-bis(hydroxymethyl) tricyclo(5.2.1.0)decane.

21. The method of claim 1, wherein the coated abrasive product, when fully cured, has a tensile strength of at least 20 MPa, a Young's modulus of at least 500 Mpa, and an elongation at break of at least 1%.

* * * * *